US006135382A

United States Patent [19]

Kaufmann et al.

[11] Patent Number: 6,135,382

[45] Date of Patent: Oct. 24, 2000

[54] YARN BRAKE

[75] Inventors: Richard Kaufmann, Freudenstadt; Hermann Schmodde, Horb-Dettlingen; Attila Horvath, Freudenstadt; Eberhard Leins, Heiningen; Gunter Leopold, Freudenstadt, all of Germany

[73] Assignee: Memminger-Iro GmbH, Dornstetten, Germany

[21] Appl. No.: 09/164,739

[22] Filed: Oct. 1, 1998

[30] Foreign Application Priority Data

Oct. 2, 1997 [DE] Germany ..... 197 43 573

[51] Int. Cl.[7] ..... B65H 59/22

[52] U.S. Cl. ..... 242/419.3; 242/419.5; 242/150 M

[58] Field of Search ..... 242/419.3, 419.5, 242/150 M, 150 R

[56] References Cited

U.S. PATENT DOCUMENTS

| | | | |
|---|---|---|---|
| 1,424,124 | 7/1922 | Taylor . | |
| 1,462,292 | 7/1923 | McKean | 242/150 R |
| 3,181,569 | 5/1965 | Carroll | 242/150 R |
| 4,449,355 | 5/1984 | Moore et al. | 242/150 M |
| 5,560,557 | 10/1996 | Horvath et al. . | |
| 5,782,424 | 7/1998 | Horvath et al. . | |

FOREIGN PATENT DOCUMENTS

| | | |
|---|---|---|
| 53 01 507 C2 | 8/1994 | Germany . |
| 44 09 450 A1 | 9/1995 | Germany . |

*Primary Examiner*—John M. Jillions
*Attorney, Agent, or Firm*—Frishauf, Holtz, Goodman, Langer & Chick, P.C.

[57] ABSTRACT

A yarn brake having two disklike or platelike brake elements pressed resiliently against one another has a substantially U-shaped bail (19) with two legs extending in spaced apart fashion an either side of the brake elements. Pinlike bearing means for the brake elements are secured to this bail by means of at least one bearing part receiving them, which part is embodied on or joined to at least one of the bail legs. At least one of the brake elements has a central opening, through which the bearing means extend.

30 Claims, 6 Drawing Sheets

YARN BRAKE

FIELD OF THE INVENTION

The invention relates to a yarn brake, or yarn tension device, having two disk-like or plate-like brake elements, pressed resiliently against one another by loading means, and between which elements at least one yarn to be braked can be passed and of which at least one brake element has a central opening.

BACKGROUND OF THE INVENTION

So-called disk or plate yarn brakes of this kind are known in many versions in textile technology. Especially advantageous modern constructions are described for instance in German Patents DE 41 04 663 C1 and DE 43 01 507 C2, both owned by the present Assignee. They all have pin-like bearing means, which are disposed, extending through the central opening of the at least one brake element, and on which at least this brake element is rotatably supported. There are embodiments in which the diameter of a bearing pin forming the pin-like bearing means is substantially less than the diameter of the central opening of the brake elements, so that the brake elements are suspended, swinging freely, from the bearing pin. Other versions use pin-like bearing means embodied in the form of a bolt, whose diameter is only slightly smaller than the opening diameter of the brake elements (see for instance FIG. 5 of DE 41 04 663 C1). The brake elements are provided with plastic bearing bushes, to improve their bearing conditions on the bolt or on a ceramic bearing bush slipped onto this bolt. The loading means pressing the brake elements elastically together are either compression springs, in the conventional manner, or else permanent magnetic rings are used for this purpose, which are placed in the shell-like, ferromagnetic brake elements.

In order to guide the yarn to be braked properly between the brake elements, yarn deflection pins, yarn eyelets and other such yarn guide means are provided, depending on the particular construction involved. As a rule at least some of these means are provided directly on the retention means that support the bearing pin or bolt for the brake elements. The arrangement is usually such that the bearing pin or bolt is floatingly suspended from the retention means. Moreover, in those embodiments in which the brake elements, as noted, are suspended swinging from a bearing pin of small diameter, the brake elements are assigned lateral stop elements spaced apart from them, which limit the otherwise free motion of the brake elements in the axial direction and guard against the brake elements escaping from their bearing means.

The retention means with which the yarn brake is secured to the housing of a yarn supply apparatus are all comparatively complicated, which is true particularly when the yarn brake cooperates with a vibration generating device that sets the brake elements into vibrational motions, which are primarily oriented crosswise to the bearing axis (DE 41 04 663 C1) or in a direction at right angles to it (DE 4 4 09 450 C2). Because the brake elements or their bearing means are set into vibration, the lint deposits, soiling and so forth that otherwise occur, originating in yarns that are hard to process, are largely averted. This provision has therefore gained excellent acceptance in the industry.

Yarn brakes of the above type are fundamentally mass-produced articles, which means that the production cost is a decisive factor in determining commercial success. Moreover, they must be easy to maintain and especially easy to clean, which as a rule is done by blowing a stream of compressed air at them. It should be avoided that the brake elements might escape from their bearing means or that blown-off dirt particles, lint and the like might collect in corners or dead spaces of retaining elements, bearing parts, etc. of the yarn brake and thus over the long term threaten the operational reliability of the yarn brake.

Moreover, a yarn brake must often meet the demand for easy assembly and disassembly, in addition to the capability of convenient, effective cleaning.

SUMMARY OF THE INVENTION

A object of the invention is therefore to create a yarn brake which, with a simple, economical design, is distinguished by having few opportunities for dirt deposits and by easy cleaning, as well as by disassembly and assembly of its parts as needed; at the same time, perfect, uniform yarn braking over long periods of operation should be assured.

To attain this and other objects of the invention, the retention means for the pinlike bearing means that carry the disklike brake elements have a substantially U-shaped bail with two legs extending spaced apart from the brake elements on both sides, the bail in a preferred embodiment being a one-piece bent wire part. The pinlike bearing means are secured to this bail by means of a bearing part that preferably receives them on both sides and that is joined to the bail legs or embodied on them. In a preferred embodiment, this bearing part may be in the form of a substantially U-shaped frame and may be made from plastic. The bail may have two bail portions parallel to one another, with which it is supported in a receiving part, which can be secured at a suitable point to a machine frame or the like, or also to the housing of a yarn supply apparatus. The bail portions may be supported longitudinally displaceably in the receiving part, which is important especially if at least one of the bail portions is arranged for coupling with a vibration generating device that imparts a reciprocating vibrational motion to the bail. In this way, as already noted, the deposition of lint and so forth can be effectively prevented.

As a rule, the bearing part that receives the pin-like bearing means can be embodied as removable from the bail, so that the bearing means can be replaced together with the bearing part. Depending on the intended use and on the construction of the yarn brake, the bearing part can also be disposed adjustably on the bail, for instance to make it easier to clean the yarn brake or to change the course of yarn travel. If the bearing part is embodied as a U-shaped frame, then the frame can be embodied as pivotable on the bail between an operation position and a folded-away position and can be fixed on the bail in the operating position.

This presents an especially simple possibility for maintenance of the yarn brake.

The frame, fixed positionally correctly on the bail in the operating position, merely needs to be folded out of the way to make the pin-like bearing means accessible, so that air can be blown against them on all sides or they can be cleaned in some other way. If the pin-like bearing means are releasably secured to the frame, or in other words in more general terms on the bearing part, then with the frame folded away they can simply be removed and replaced. As an alternative, the yarn brake may also be embodied such that the entire frame, together with the bearing means and the brake elements, can be replaced without having to remove or take apart the bail or the other parts of the yarn brake. Folding the frame out of the way and optionally removing it, as well as replacing the bearing means, can be done without the aid of tools. Since the pin-like bearing means are supported on both sides in the bearing part, by comparison to the known floating bearing of the bearing pins a substantially more favorable braking of the pin-like bearing means is assured. This makes it possible to make do with straight bearing pins of relatively small diameter, without having to make the sacrifice of increased risk of breakage upon vibrational impingement by a vibration generating device. Since as a rule these bearing pins are of a hard material, such as ceramic, mechanically resistant material, and the like and are relatively expensive, a considerable price advantage can be attained in this way.

The novel yarn brake is suitable particularly for use in a yarn supply apparatus that is embodied with a housing, a yarn supply drum rotatably supported on the housing, and a drive device connected to the yarn supply drum, as well as with yarn guide means disposed on the housing. The yarn guide means are used to guide the yarn arriving from some yarn supply, such as a bobbin, and to be delivered to a yarn consumer to the yarn supply drum on its inlet side and to guide the yarn away from it on the outlet side to the yarn consumer. In such a yarn supply apparatus, a yarn brake of the invention is disposed on the yarn inlet side of the housing. In the embodiment of the novel yarn brake as explained, with a U-shaped bail embodied as a bent wire part and whose bail has two parallel bail portions with which it is supported in a receiving part, the parallel bail portions can be supported directly in the housing or in a part connected to it, such as the receiving part. If the yarn supply apparatus is equipped with a vibration generating device accommodated in the housing, then once the yarn brake is mounted on the housing, coupling of the bail to this vibration generating device is achieved directly. To this end, at least one of the bail portions is arranged for coupling to a vibration generating device that imparts a reciprocating vibrational motion to the bail. At the same time, at least one of the bail portions may be loaded by restoring spring means that elastically press it toward a predetermined terminal position, so that it suffices for the bail portion to be supported on a cam or tappet of the vibration generating device without having to be positively coupled with it.

DETAILED DESCRIPTION OF THE PREFERRED EMBODIMENTS

Figure 1:
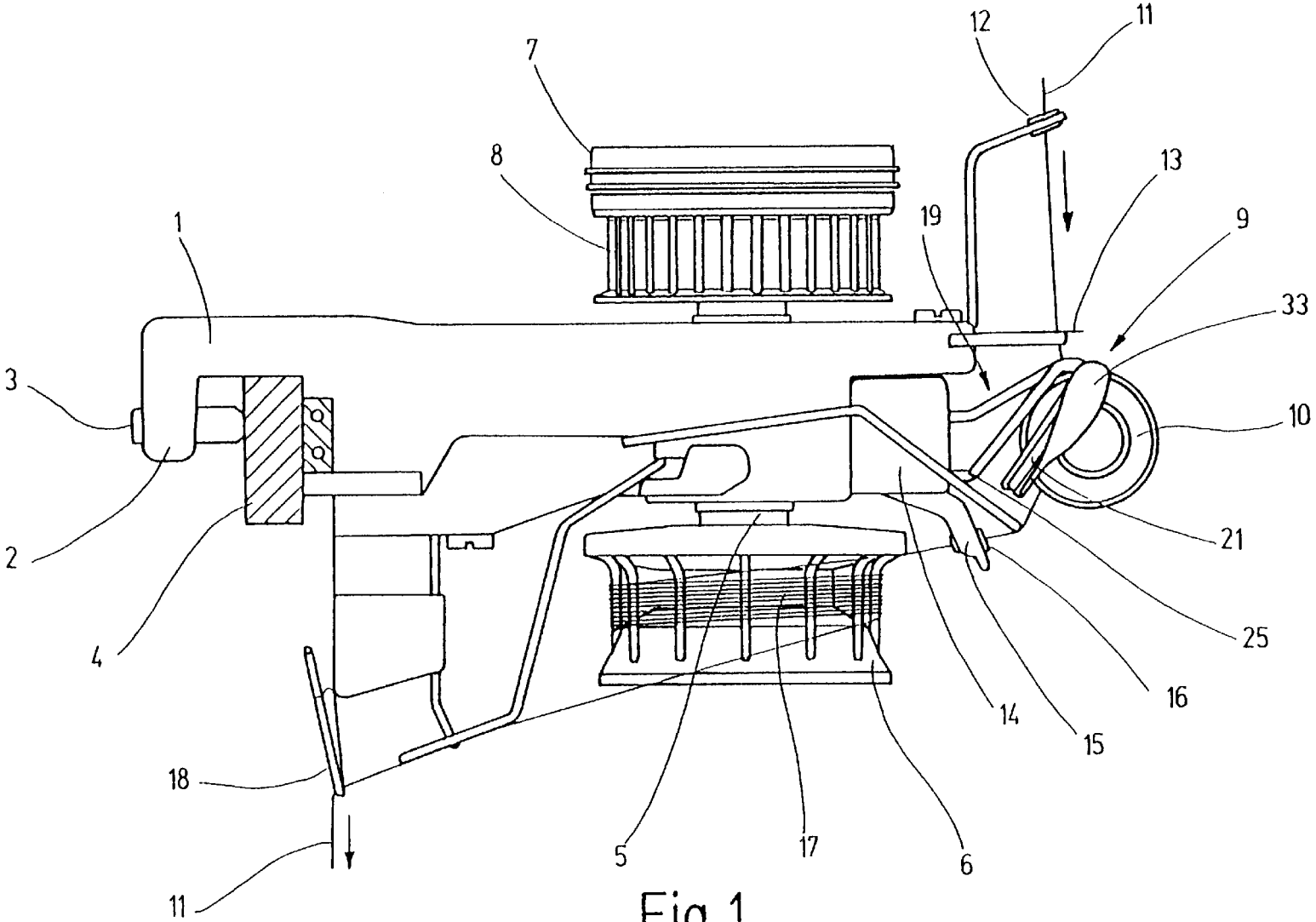
FIG. 1, a yarn supply apparatus with a yarn brake according to the invention, in a side view.

The yarn supply apparatus shown in FIG. 1 is known in terms of its basic design (see for instance FIG. 1 of German Patent DE 43 01 50 7 C2). It has a housing 1, which can be secured by means of a formed-on retaining 2 and a clamping screw 3 to a bearing ring, suggested at 4, for instance of a circular knitting machine. A continuous shaft 5 which is vertical in its position of use is rotatably supported in the housing. The shaft is connected on its lower end, in a manner fixed against relative rotation, to a yarn supply drum 6 disposed below the housing 1 and embodied in the form of a cage made of bars. On its upper end, it has a pulley 8, which can be coupled in a manner fixed against relative rotation via a coupling and which forms its drive device, and by way of which the yarn supply drum 6 can be made to revolve by an endless toothed or perforated belt or the like, not shown in further detail.

Disposed on the face end of the housing 1 opposite the retainer 2 is a yarn brake 9, which has two identically embodied, essentially disk-like brake disks 10, between which a yarn 11 to be braked travels. The yarn travel course extends from a yarn bobbin, not further shown, through a yarn eyelet 12 secured to the housing 1, a knot catcher 13 and the yarn brake 9, to a yarn inlet eyelet 16, provided on a base or receiving part 14 via a formed-on arm 15; from this eyelet, the yarn 11 runs up on the inlet side onto the yarn supply drum 6. On the yarn supply drum 6, the yarn 11 forms a storage winding 17, from which it runs via a yarn outlet eyelet 18, secured to the housing 1, to the yarn consumer.

As can be seen particularly in FIGS. 3–6, the yarn brake 9 has a substantially U-shaped bail 19, embodied as a one-piece bent wire part, which forms the retention means for the brake disks 10 and their bearing means in the form of a cylindrical bearing pin. The bail 19 has two parallel legs 21, which are joined together at one end by a crossbar 22 that adjoins the bail legs 21, in each case forming a right angle. On their other end, the two legs 21 of the bail are joined to two parallel, straight bail portions 25, in each case via a bend 23 of approximately 30° and intervening, suitably shaped intermediate portions 24. In this exemplary embodiment, the parallel bail portions 25 are at different levels, relative to the crossbar 22 which is horizontal in the position for use, and they form an angle of approximately 30° with an imaginary plane that contains the crossbar 22 and the two legs 21 of the bail. The bail portions 25 may also optionally be located at the same level as the intermediate portions 24, to name only some possible dispositions.

Figure 2:
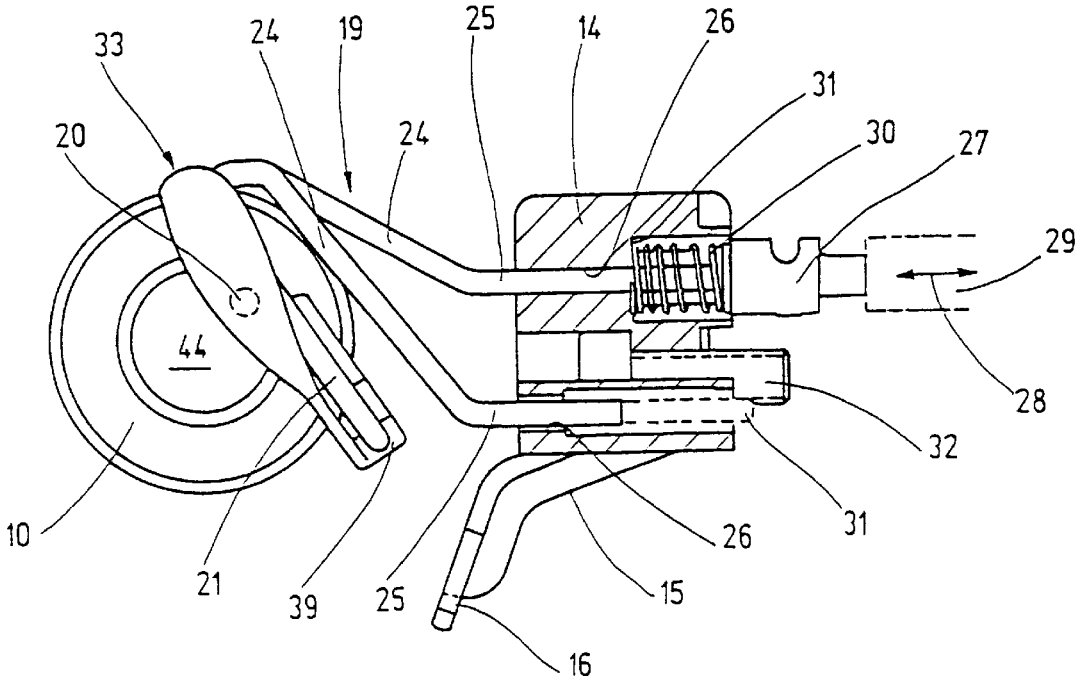
FIG. 2, the yarn brake of the yarn supply apparatus of FIG. 1, in a side view and on a different scale.
Figure 5:
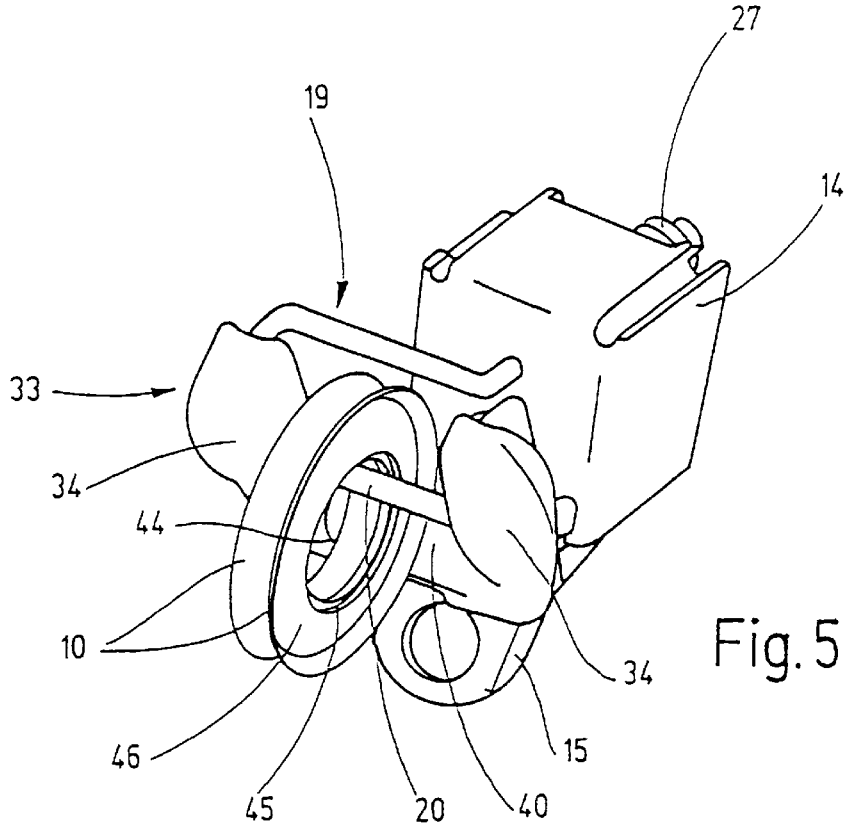
FIG. 5, the yarn brake of FIG. 2 in perspective.

With its two parallel bail portions 25, the bail 19 is longitudinally displaceably supported in the housing-like base or receiving part 14, as can be seen particularly in FIG. 2. The substantially parallelepiped, plastic base or receiving part 14 to that end has two cylindrical bearing bores 26, extending continuously from the front side to the back, in which the bail portions 25 are longitudinally displaceably guided with a horizontal alignment, in the position for use. The straight bail portions 25 are offset from one another both in terms of height (FIG. 2) and laterally (FIG. 5).

The top bail portion 25, on its end protruding past the back side of the base or receiving part 14, has a plastic coupling part, embodied substantially as a cylindrical cap 27, for a vibration generating device, disposed in the housing 1 but not further shown, of which only a drive ram 29, represented by an arrow 28 and executing a reciprocating motion, is shown in FIG. 2. The drive ram 29 is actuated by a cam, not shown, which is mounted on the shaft 5 of the yarn supply apparatus of FIG. 1, and with which the ram is in engagement.

A compression spring 30 surrounding the top, straight bail portion 25 is disposed in the base or receiving part 14; it is braced against an axial spring abutment 31 and seeks to keep the coupling part 27 in contact with the drive ram 29. The compression spring 30 therefore forms restoring spring means.

The lower, straight bail portion 25 protrudes somewhat at 31, for instance from the back side of the base or receiving part 14, as indicated by dashed lines in FIG. 2. When the base or receiving part 14 is mounted on the housing 1, it rests on a part of the metal housing 1 and thus accomplishes electrical grounding of the metal bail 19. As an alternative or in addition, to improve the grounding conditions, the bail 19 may also press a grounding spring (not shown) against the housing 1, and/or the base 14 and/or the cap 27 may comprise an electrically conductive material.

For securing the base or receiving part 14 to the housing 1, a fastening screw indicated at 32 is used, which can be actuated from the front side of the base or receiving part 14.

Figure 4:
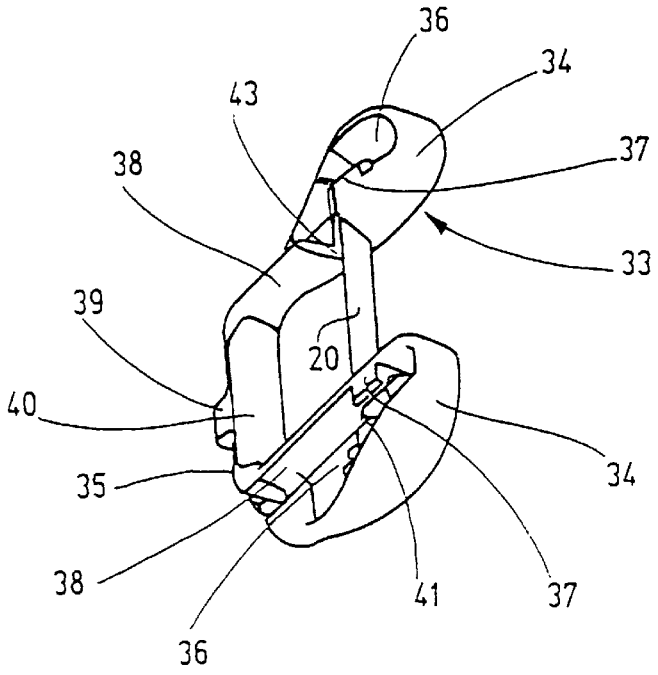
FIG. 4, the frame with the bearing pin of the yarn brake of FIG. 2, in an enlarged perspective view.

A bearing part in the form of a plastic, essentially U-shaped frame 33 is mounted on the legs 21 of the bail 19, which are parallel and in the same plane and enclose an angle of approximately 30° with the vertical, in the normal operating position shown in FIG. 2; the bearing pin 20 for the brake disks 10 is retained on both ends in the frame 33, as shown particularly in FIG. 4. The frame 33 has spaced-apart frame legs 34, parallel to one another, which are joined to one another on one end by a formed-on crossbar 35 of the frame. On the inside, toward the observer in FIG. 4, each of the two parallel legs 34 of the frame are embodied with a groove-like indentation 36, into which a detent protrusion 37 protrudes in the vicinity of the free end of the frame leg. The detent protrusions 37 are embodied on the wall 38 that defines the groove-like indentations 36 on the side of the U-shaped opening of the frame 33. These protrusions serve to lock the frame 33 releasably to the legs 21 of the bail 19 in the operating position, as will be described in further detail hereinafter.

The crossbar 35 of the frame is provided on its outside with a formed-on bearing shell or claw 39, which can be seen for instance in FIGS. 2 and 4 and which, when the frame 33 is mounted on the bail 19, elastically embraces the crossbar 22, so that the frame 33 is pivotably supported on the crossbar 22. The bearing shell or claw 39 is embodied as elastically resilient, in such a way that the frame 33 can easily be removed from the bail 19 by overcoming the detent connection formed by this shell or claw.

On its inside, toward the bearing pin 20, the frame crossbar 35 is embodied as a bearing or support pad 40 for the brake disks 10. To that end, the frame leg 35 may be provided on the inside with a wear-resistant coating, for instance. Embodiments are also conceivable in which a pin made of wear-resistant material or a suitable molded or shaped part is inserted into the frame 33 and forms the bearing or support pad 40. Depending on the conditions of use, there are also cases in which an especially wear-resistant embodiment of this bearing or support pad 40, which as a rule occupies the entire space between the two frame legs 34, is dispensed with.

The slender, cylindrical bearing pin 20, made of hardened steel, optionally with a wear-resistant coating, or of ceramic or some suitable mechanically resistant material, is inserted on one end, the lower end in FIG. 4, into a bearing bore 41 made in the inner wall 38. On its opposite end, the bearing pin 20 is received in a bearing half-shell 43, provided on the associated frame leg 34 and open toward the groove-like indentation 36, the half-shell being formed onto the frame leg 34. The depth of this bearing half-shell 43 is selected such that the inserted bearing pin 20 protrudes with its jacket face somewhat beyond the bottom of the groovelike indentation 36. It is thus accomplished that when the frame 33 is locked to the bail legs 21 in the position for use, the bearing pin 20, which in this case is of metal, is electrically conductively pressed elastically against the legs 21 of the bail, thus assuring perfect grounding of the bearing pin 20 via the metal bail 19 and the housing 1. The bearing pin 20 may also be of nonconductive material, such as ceramic, which should be mentioned for the sake of completeness.

The two brake disks 10 are suspended, swinging freely, from the bearing pin 20. To that end, in the manner shown particularly in FIGS. 5 and 6, they are each embodied with a central, cylindrical, continuous opening 44, whose diameter is multiple times greater than the diameter of the bearing pin 20. The diameter ratio is typically approximately 6:1 or more. The brake disks 10, embodied with a crowned, shell-like cross-section, can each be embodied along the boundary of the opening 44 with a hub 45, formed on as a cylindrical lip, to reduce the strain on the brake disks 10 and bearing pin 20 and to prevent the brake disks from cutting into the bearing pin 20. As an alternative, in each of the brake disks 10, the boundary of the opening 44 may be enclosed by an inserted hug ring of plastic or some material providing the proper pairing with the bearing pin 20, as will also be explained below in conjunction with FIG. 10. Permanent magnet rings 46 are inserted from outside into the toroidal indentation in the brake disks 10 and are magnetized such that they press the brake disks 10 against one another and thus form their loading means; the magnitude of the loading force determines the braking action on the yarn passing through.

Figure 3:
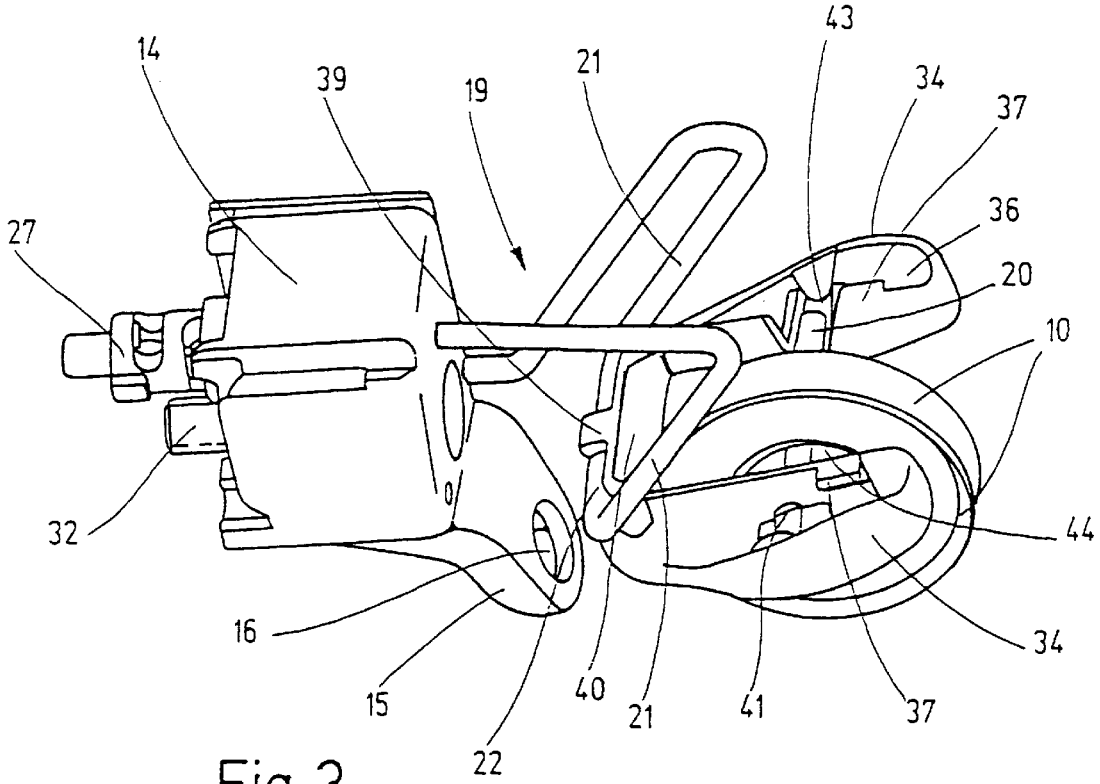
FIG. 3, the yarn brake of FIG. 2, in a perspective view with the frame folded away and on a different scale.

As seen for instance from FIGS. 3 and 5, the two frame legs 34, in the mounted state, are spaced apart by a considerable distance from the two brake disks 10. The two brake disks 10 contacting one another are therefore freely movable in the axial direction over a considerable length of the bearing pin 20. They may execute a pendulum-like and a tumbling motion during operation. They are held captive in the frame 33, however, by the two frame legs 34 in cooperation with the slender bearing pin 20.

In the operating state, the frame 33 is clipped onto the horizontal crossbar 22 of the bail 19, with the brake disks 10 suspended from the inserted bearing pin 20, by the bearing shell or claw 39 of the frame. Moreover, the frame is folded upward about the axis of the crossbar 22 far enough that the two legs 21 are received in the groovelike indentations 36 of the frame legs 34, and the frame 33 is locked to the legs 21 via the detent protrusions 37. The yarn brake is then in the state shown in FIGS. 1 and 2, in which the yarn 11 passing between the brake disks 10 is braked uniformly to the extent defined by the force of attraction of the permanent magnet rings 46. The two brake disks 10 pressed against one another are then driven with frictional engagement by the yarn 11, which is deflected around the bearing pin 20, or around a yarn deflection pin not further shown in the drawing but extending through the openings 44 of the brake disks 10 and retained in the frame legs 34, causing the brake disks to execute a common rotary motion about the bearing pin 20. This revolving motion has a tumbling motion in the axial direction superimposed on it, since as noted the two brake disks do not have a fixed lateral guide. In this way it is accomplished that the yarn 11 cannot cut into the brake surfaces of the brake disks 10, but instead the brake surfaces come progressively into engagement with the yarn over their entire circumference.

At the same time, via the drive ram 29 of the vibration generating device, the bail 19 is imparted a reciprocating vibrational motion, under the influence of which the bearing points on the bearing pin 20 at the boundary of the opening of the brake disks 10 change progressively, so that the brake disks 10 execute an irregular motion that prevents the deposition of lint and the like.

Since the brake disks 10, as described, are retained solely by the U-shaped frame 33 and the U-shaped bail 19 embodied as a bent wire part, there are only a few surfaces in the entire yarn brake on which lint can be deposited at all.

At the same time, excellent cleaning conditions are achieved, because the yarn brake 9 has no dead spaces or corners in which dirt or the like could collect when a stream of compressed air is blown at the yarn brake.

For instance, to further simplify cleaning after especially heavily soiled yarn is processed, or to replace the bearing pin 20, the frame 33 can simply be folded downward about the crossbar 22, by overcoming the detent protrusions 37, out of the operating position of FIG. 2 into a position shown in FIG. 3, in which the two brake plates 10 are folded out of the space between the two legs 21 of the bail. In this position, both brake disks 10 are freely accessible.

To remove the brake disks 10 from the frame 33, the bearing pin 20 is pressed upward on one end out of the bearing half-shell 43, so that it can be removed axially from the bearing bore 41. Since the frame 33 is of plastic and in the folded-open state is not reinforced by the legs 21 of the bail, it is elastically deformable in such a way that the described disassembly of the bearing pin 20 can easily be accomplished. A new bearing pin 20 can be inserted again in reverse order.

As an alternative, one may also proceed in such a way that the entire frame 33, with the bearing pin 20 and the brake disks 10, is removed as already described from the crossbar 22 of the bail and optionally replaced with a new frame 33. Once the cleaning work is completed or after the bearing pin 20 or brake disks 10, etc., have been replaced, the frame 33 is simply folded back up into the operating position of FIGS. 2 and 5 from the folded-away position, and in this operating position locked to the legs 21 of the bail 19 via the detent protrusions 37. As FIG. 2 shows, the legs 21 of the bail in the operating position extend on both sides of the brake disks 10, so that these disks are received between these two legs 21 in the U-shaped opening of the bail 19.

The arrangement may also be made such that the bearing pin 20 is removable directly axially out of the frame 33, by being retaining in at least one bearing bore 41 that opens to the outside. The bearing pin 20 would then be secured in its operating position in the frame 33 by a fixation mechanism, for instance in the form of a detent mechanism or by being partly embodied as a threaded bolt. Other embodiments that serve the same purpose are also conceivable.

Embodiments of the novel yarn brake are also conceivable in which the frame 33 is dispensed with entirely, and the bearing pin 20 is retained directly on the legs 21 of the wire bail. Such variant embodiments are shown by way of example in FIGS. 6*a* and 6*b:*

Figures 6, 6A, 6B:
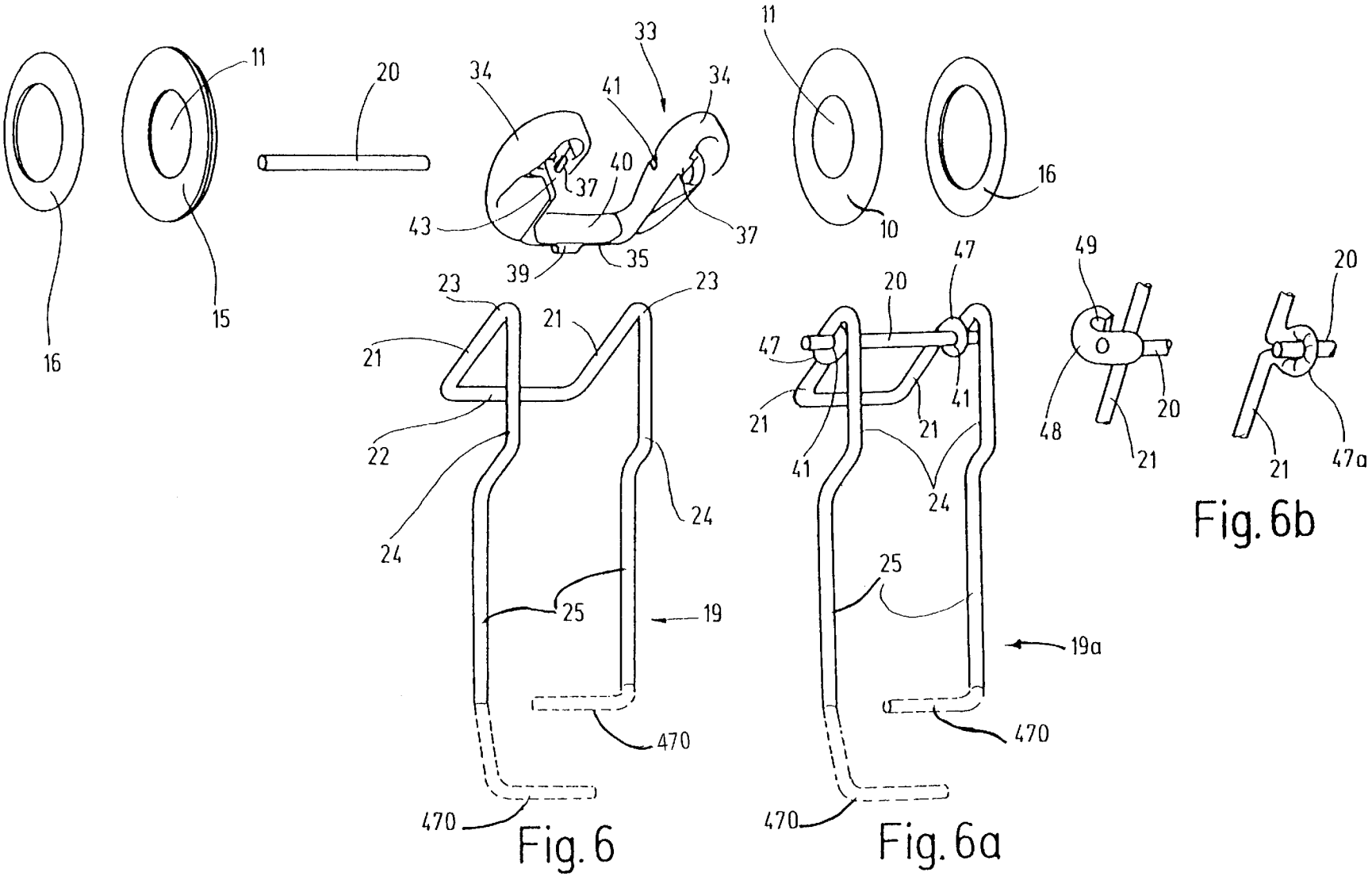
FIG. 6, the bail embodied as a bent wire part, along with the brake elements and their associated permanent magnet rings, in a perspective, exploded view, on a different scale.
FIG. 6*a*, the bail of FIG. 6 in a modified embodiment, in a corresponding perspective view.
FIG. 6*b*, the bail of FIG. 6*a*, in a detail showing two different embodiments of the bearing parts, each in perspective.

In the embodiment of FIG. 6*a*, the two legs 21 of the U-shaped wire 19*a* are each bent to form a ring eyelet 47, which defines the cylindrical bearing bore 41. The two ring eyelets 47 are aligned with their bearing bores 41, into which the bearing pin 20 is inserted. The bearing pin 20 is elastically firmly clamped by the ring eyelets 47 on both sides. If necessary, it may also have a detent indentation, for instance in the form of an annularly encompassing detent groove, in the region of at least one bearing bore 41 in order as an alternative, or in addition, to establish a positive connection with the respective leg 21 of the bail. Instead of the embodiment with the ring eyelets 47 described that each completely encompass the bearing bore 41, the legs 21 of the bail may also be bent in such a way that they form Ω-shaped eyelets 47*a*, as shown on the right in FIG. 6*b*.

Finally, bending the bail legs 21 into eyelet form may optionally even be omitted entirely. Instead of the ring eyelets 47 or Ω-shaped eyelets 47*a*, a hooklike retaining claw 48, as shown on the left in FIG. 6*b*, may also be used, clipped onto the respective bail leg 21 and held there by frictional engagement. The retaining claws 48, preferably made of plastic, are slipped on the ends onto the bearing pin 20. With their retaining jaw 49, they grasp the respective bail leg 21 on which they are nondisplaceably held by frictional engagement.

In the embodiments described, the one, straight bearing portion 25 is held by the compression spring 30 (FIG. 2) in elastic contact with the actuating tappet 29 (or an actuating cam) of the vibration generating device. To reduce wear at the point of contact, the coupling part 27 embodied as a plastic cap is used. Instead of the compression spring 30, it would also be conceivable to attain the restoration of the bail 19, or the pressing of its bearing portion 25 against the drive tappet 29, by embodying the wire bent part that forms the bail 19 with a suitable elastic initial tension. Even force-guided embodiments with two bearing points of this wire bent bar on the drive ram 29 or on the drive cam are possible. Such a variant is suggested in FIG. 6. The bearing portions 25 are bend toward one another at approximately a right angle at 470. The drive ram or tappet 29 could be coupled between the spaced-apart, bent parts 470 of the bail, for example.

If the yarn brake 9 is used without a vibration generating device, then the straight bearing portions 25 are fixed in the base or receiving part 14, for instance by means of clamping screws.

In FIGS. 6–10, three different alternative embodiments of the frame 33 are shown.

Figure 7:
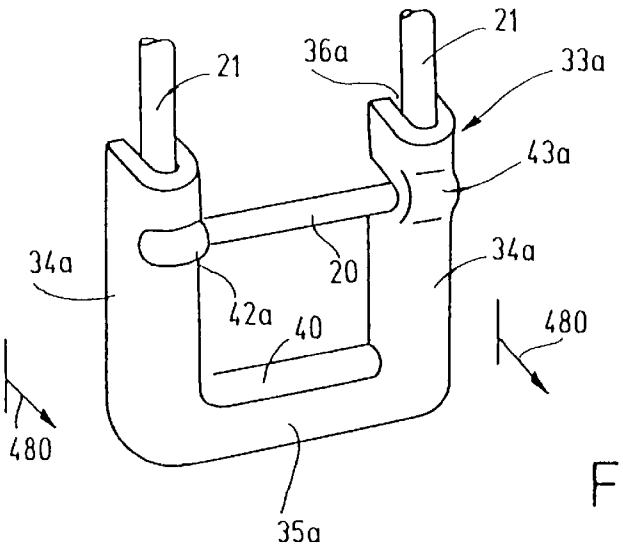

In the embodiment of FIG. 7, the one-piece, substantially U-shaped frame 33*a* is embodied with a groovelike indentation 36*a*, open toward the back side, extending around the frame along the legs 34*a* and crossbar 35*a* of the frame. By suitable dimensioning of the indentation 36*a*, the frame 33*a* is clamped to the bail legs 21 and the bail crossbar 22. It can be removed as a whole toward the front, as indicated by the two arrows 480. The bearing pin 20 is retained in the frame 33*a*, in a manner similar to what is shown in FIG. 4. A bearing projection and the bearing half-shell are indicated at 42*a* and 43*a*, respectively.

Figure 8:
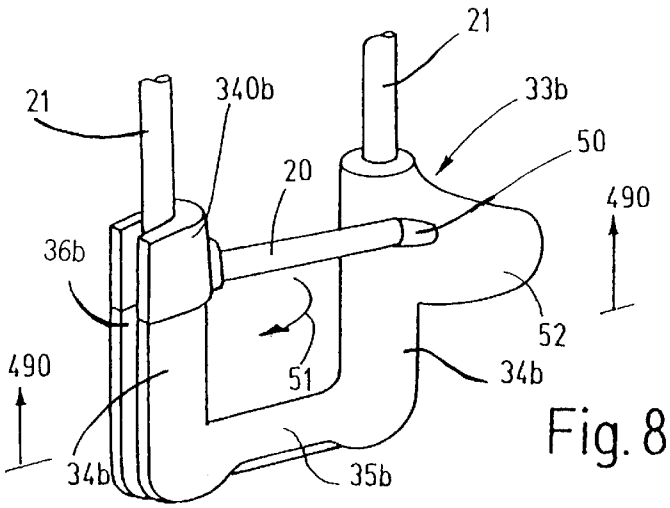

In the embodiment of FIG. 8—as in all the embodiments—the frame 33*b* is made from plastic. Its two legs 34*b* and the crossbar 35*b* are each embodied with a groovelike indentation 36*b*, located in the plane of the two bail legs 21 and open toward the outside, in which the bail legs 21 rest. It is possible in this way to displace the entire frame 33*b* on the bail legs 21 in the direction of the arrows 490, for instance to modify the operating conditions of the yarn brake. The frame 33*b* is held it its position at any given time by frictional engagement on the bail legs 21. The bearing pin 20 is in this case retained on one end in its own leg portion 340*b,* which grasps the associated bail leg 21 in U-shaped fashion and is frictionally coupled with it; the portion 340*b* may also be locked to the leg 21 in detent fashion. On its other end, the bearing pin 20 is received in a groovelike indentation 50, open on one side, of the associated frame leg 34 and is locked in detent fashion or clamped therein. To replace the bearing pin 20 or the brake disks 10, the bearing pin 20 is folded outward about the left-hand leg 21, as indicated by an arrow 51. It can then be pulled out of its leg portion 340*b*.

An actuating protrusion 52 formed onto the frame 33*b* allows the displacement of the frame 33*b* in the direction of the arrows 490.

Figure 9:
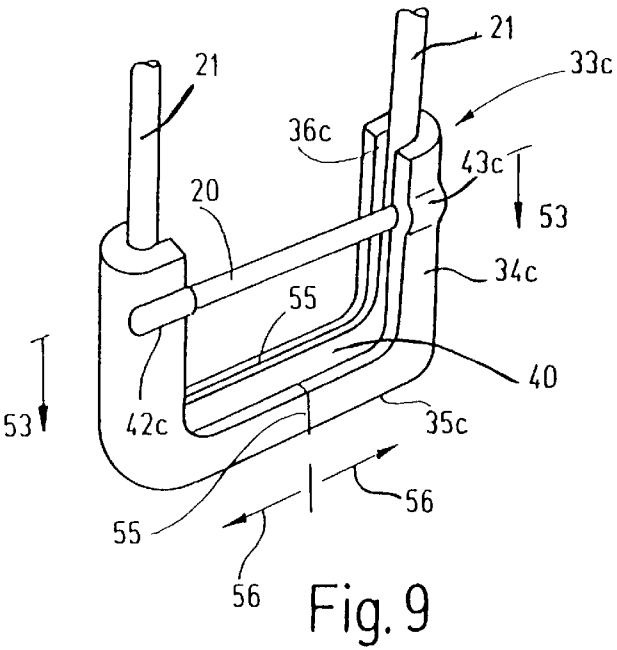
FIGS. 7–9, three different exemplary embodiments of the frame of the yarn brake of FIG. 2, in each case in a schematic, perspective view, showing one part of the bail embodied as a bent wire part, and on a different scale.

In the embodiment of FIG. 9, the frame 33*c* is embodied in two parts. The frame legs 34*c* and the frame crossbar 35*c* are provided with a continuous, groove-like indentation 36*c*, whose open sides face toward the space defined by the two bail legs 21. The entire frame 33*c* can therefore be displaced downward, in the direction of the arrows 53, on the legs 21 or removed from them entirely. Optionally, however, the two frame legs 34*c*, which are separated from one another along a parting seam 55 in the frame crossbar 35, may be pulled laterally off from the legs 21. This is indicated by two arrows 56. The retention of the bearing pin 20 on the frame legs 34*c* is undone in a manner similar to that of FIG. 4. Corresponding parts are identified by the same reference numerals.

In the embodiments of FIGS. 8, 9, the bearing or support pad 40 for the brake disks 10 is not shown in detail. It may be embodied similarly to that of the frame 33 of FIG. 4. In either case, it serves to limit the radial course of motion of the brake disks 10 on their outer circumference. The brake disks 10 suspended from the bearing pin 20 rest, in their operating position shown in FIG. 2, on the bearing or support pad 40 and move away from it more or less frequently in the course of their irregular tumbling and rotary motion.

Figure 10:
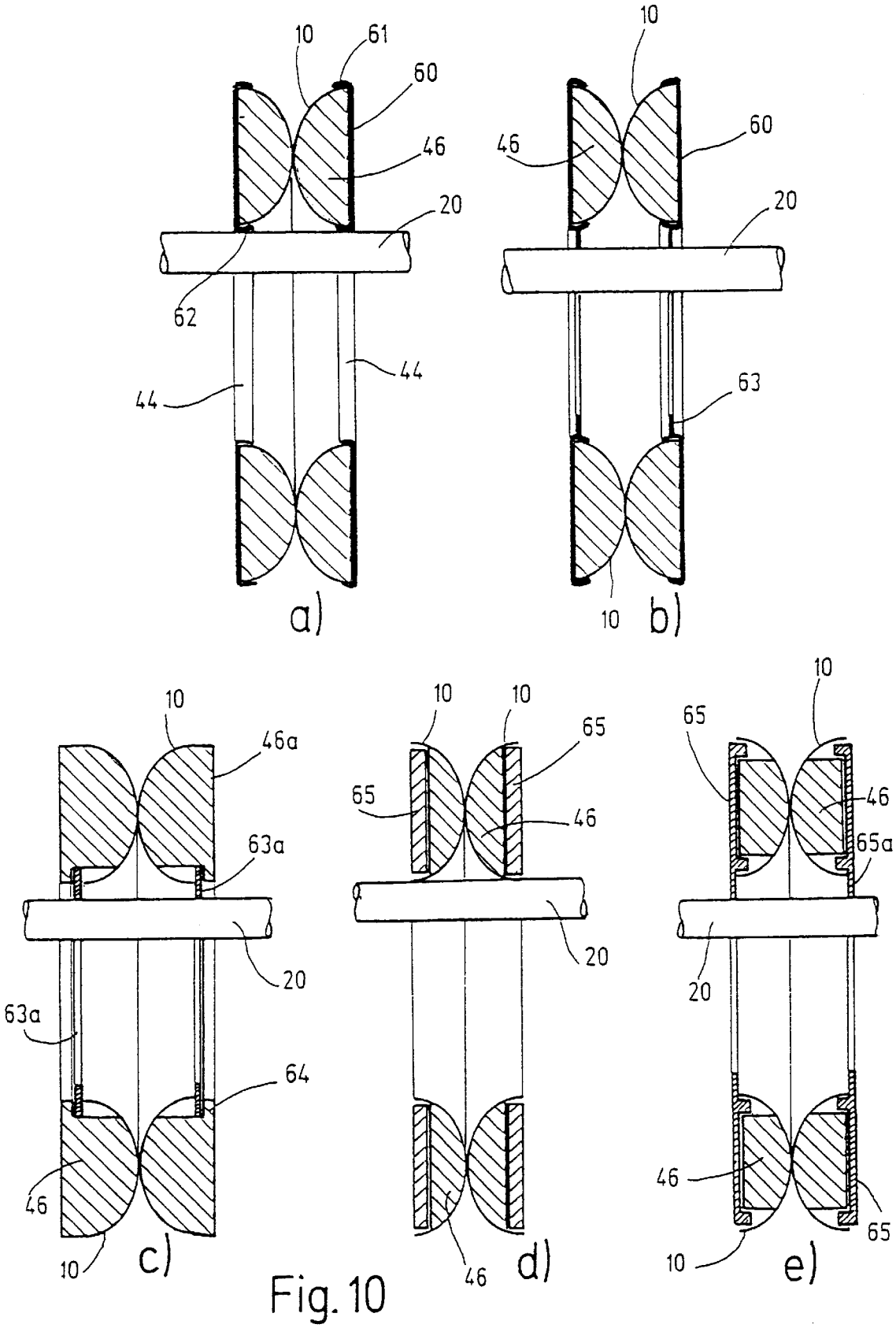
FIGS. 10*a*–10*e*, the brake disk and the bearing means of the yarn brake of FIG. 1 in five different embodiments, each in axial section, shown in a schematic side view and on a different scale.

As already mentioned earlier, it may be expedient, for instance depending on the conditions of use of the yarn brake 9, to adapt especially the seating conditions of its brake disks 10 on the bearing pin 20 to the prevailing conditions of use. Examples of this are schematically shown in FIG. 10:

In embodiment a), annular caps 60 made of a suitable plastic are clipped onto the brake disks 10 and with their annularly encompassing protruding peripheral regions 61, 62 they grasp the brake disks 10 on the outer circumference and along the circumference of the opening 44, in which a way that they are locked in detent fashion to the brake disks 10. The caps 60 cover the hollow of the crowned brake disks 10 as shown, and at the same time they fix the permanent magnet rings 46 positionally correctly, so that as a rule it is no longer necessary also to glue them in place or the like.

The rim 62 surrounding the opening 44 at the same time forms an essentially tubular hub, which is optionally embodied with a curved cross section as well. In this way, especially favorable seating conditions of the brake disks 10 on the bearing pin 20 are obtained.

In this connection, it may also be expedient to form an annular-disk-like lip 63 on the rim 62 surrounding the opening 44, as shown at b). The annular-disk-like lips 63 make the axial width of the bearing face slight, and thus make for increased pressure exerted per unit of surface area. This may be advantageous if it must be expected that yarn sizing or other resinous or sticky deposits will build up on the bearing pin 20.

If the caps 60 are omitted, then it is possible, as shown at c), to embody the annular-disk-like lip in the form of an annular disk 63*a* that is slipped onto the permanent magnet ring 46*a*, which to that end is provided with an annular shoulder 64. The permanent magnet rings 46*a* are adhesively bonded to the brake disks 10, and the annular disks 63*a* are each inserted between their edge and the annular shoulder 64 of the corresponding permanent magnet ring 46*a*.

Instead of the caps 60 grasping the brake disks 10 as in a) and b), it is also possible for an annular-disk-like lid 65 to be clipped into the crowned brake disks 10, as shown at d) and e). This lid 65, which in particular is of plastic, keeps the permanent magnet ring 46 positionally fixed, and the brake disks 10 are seated directly on the bearing pin 20 on the inner edge of their opening 40.

An annular-disk-like lip 65*a* of slight thickness may also be formed onto this clipped-on lid 65 that retains the permanent magnet rings; this lip forms the hub of the brake disks 10, resulting in seating conditions similar to those shown in the drawing at b) and c).

In closing, it should be noted that the invention is not limited to embodiments in which the brake disks 10 are suspended to swing from a slender bearing pin 20. It is also applicable to yarn brakes in which the brake disks are merely supported rotatably with play on a bearing bolt or bearing pin.

We claim:

1. A yarn brake for use with a yarn supply apparatus comprising:

two disk-like or plate-like brake elements being selectively pressed against one another, and between which at least one yarn to be braked is passed, at least one of the two brake elements having a central opening, a pin-like bearing element (20) extending through the central opening (44) of the at least one brake element (10), and on which the at least one brake element is rotatably supported, and a retention device for securing the pin-like bearing element, the retention device having a substantially U-shaped bail comprised from a wire of unitary construction, and including:

(i) two legs extending in spaced apart fashion on either side of the brake elements, (ii) a cross bar interposed between the two legs, the two legs being joined together at one end thereof by the cross bar, and (iii) two bail portions, parallel to one another, with which the substantially U-shaped bail is supported by a receiving part of a yarn supply apparatus housing.

2. The yarn brake of claim 1, wherein the pin-like bearing element is secured to the substantially U-shaped bail by at least one bearing part embodied on at least one of the two legs of the substantially U-shaped bail.

3. The yarn brake of claim 2, wherein said at least one bearing part includes eyelet-like bearing parts.

4. The yarn brake of claim 1, wherein the two bail portions are longitudinally displaceably supported in the receiving part.

5. The yarn brake of claim 4, wherein at least one of the two bail portions is coupled to a vibration generating device which imparts a reciprocating vibrational motion to the substantially U-shaped bail.

6. The yarn brake of claim 5, wherein at least one of the two bail portions includes a compression spring that elastically presses at least one of the two bail portions toward a predetermined terminal position.

7. The yarn brake of claim 1, wherein each of the two legs have a bend.

8. The yarn brake of claim 2, wherein the at least one bearing part is removable from the substantially U-shaped bail.

9. The yarn brake of claim 2, wherein the at least one bearing part is adjustably disposed on the substantially U-shaped bail.

10. The yarn brake of claim 2, wherein the at least one bearing part comprises a substantially U-shaped frame.

11. The yarn brake of claim 10, wherein the substantially U-shaped frame is lockably disposed in detent fashion on the substantially U-shaped bail.

12. The yarn brake of claim 10, wherein the substantially U-shaped frame is pivotable on the substantially U-shaped bail between an operating position and a folded-away position and wherein the substantially U-shaped frame is fixable on the substantially U-shaped bail in the operating position.

13. The yarn brake of claim 10, wherein the substantially U-shaped frame has a portion thereof which functions as a brace for the brake elements.

14. The yarn brake of claim 10, wherein the substantially U-shaped frame is releasably secured to the substantially U-shaped bail.

15. The yarn brake of claim 10, wherein the substantially U-shaped frame includes two parts.

16. The yarn brake of claim 13, wherein a first end of the pin-like bearing element is disposed at one end on a frame part pivotably supported on a bail leg, and the other frame part has a receiver for coupling to a second end of the bearing element.

17. The yarn brake of claim 2, wherein the at least one bearing part comprises plastic.

18. The yarn brake of claim 2, wherein the bearing element is releasably secured to the bearing part.

19. The yarn brake of claim 2, wherein the bearing element is electrically coupled to the substantially U-shaped bail by the bearing part, and wherein the substantially U-shaped bail is electrically grounded.

20. The yarn brake of claim 2, wherein the bearing part is obliquely oriented with respect to the vertical in the operating position.

21. The yarn brake of claim 1, further comprising at least one yarn guide fixedly associated with the substantially U-shaped bail.

22. The yarn brake of claim 1, wherein the bearing element includes first and second ends, and wherein both the first and second ends of the bearing element are retained on the substantially U-shaped bail.

23. The yarn brake of claim 1, wherein the two disk-like brake elements have brake disks or plates, with which a magnetic loader is associated, that are covered by, mounted on or inserted within a cover.

24. The yarn brake of claim 1, wherein the two disk-like brake elements have brake disks or plates, each of which is supported on the bearing element via an annular-disk-like hub.

25. The yarn brake of claim 1, wherein a bearing pad for said brake elements is located on said cross bar of said substantially U-shaped bail.

26. The yarn brake of claim 25, wherein a substantially U-shaped frame is mounted to at least one of the legs of said substantially U-shaped bail, wherein said substantially U-shaped frame has spaced-apart frame legs and a cross bar coupling said frame legs, and wherein said bearing pad is provided on said cross bar.

27. The yarn brake of claim 26, wherein said bearing pad is coupled to said substantially U-shaped frame.

28. The yarn brake of claim 26, wherein said cross bar comprises a wear-resistant coating.

29. A yarn supply apparatus comprising:

a housing, a yarn supply drum rotatably coupled to the housing, a drive device operatively connected to the yarn supply drum, a yarn guide, disposed on the housing, by which the yarn to be supplied is directed on an inlet side of the yarn supply drum and carried away from the yarn supply drum on an output side to a yarn consumer, and a yarn brake coupled to the housing, the yarn brake being constructed in accordance with claim 1.

30. The yarn supply apparatus of claim 29, wherein the substantially U-shaped bail has parallel bail portions, which are supported directly in the housing or in a part joined to the housing.

* * * * *